United States Patent [19]

Danova

[11] Patent Number: 4,734,948

[45] Date of Patent: Apr. 5, 1988

[54] CONVERTIBLE FIGURE

[76] Inventor: Cesare M. Danova, 121 N. Swall Dr. #2, Beverly Hills, Calif. 90211

[21] Appl. No.: 935,339

[22] Filed: Nov. 26, 1986

[51] Int. Cl.[4] ..... A47G 9/02; A63H 3/02

[52] U.S. Cl. ..... 5/502; 5/420; 446/73

[58] Field of Search ..... 5/413, 502, 500, 482, 5/420, 440; 2/69.5; 446/71-74, 369

[56] References Cited

U.S. PATENT DOCUMENTS

| | | | |
|---|---|---|---|
| D. 174,238 | 3/1955 | Stevens . | |
| D. 217,368 | 4/1970 | Klamer . | |
| D. 226,101 | 1/1973 | Marcus . | |
| D. 256,202 | 8/1980 | Schmickel et al. . | |
| D. 273,028 | 3/1984 | Finney . | |
| 820,027 | 5/1906 | Tabor . | |
| 1,026,460 | 5/1912 | Rusk . | |
| 1,396,766 | 11/1921 | McClelland . | |
| 1,437,467 | 12/1922 | Dykman . | |
| 1,575,263 | 3/1926 | Guglielmi . | |
| 2,183,418 | 12/1939 | Williams . | |
| 2,195,127 | 3/1940 | Brucker . | |
| 2,274,303 | 2/1942 | Ornstein . | |
| 2,315,126 | 3/1943 | Michalke . | |
| 2,325,750 | 8/1943 | De Vries . | |
| 2,655,762 | 10/1953 | Burke . | |
| 2,678,505 | 5/1954 | Munson . | |
| 2,791,775 | 5/1957 | Sartell . | |
| 2,852,885 | 9/1958 | Mayer . | |
| 2,971,205 | 2/1961 | Shultz . | |
| 3,082,437 | 3/1963 | Upthagrove . | |
| 3,176,315 | 4/1965 | Freund . | |
| 3,226,885 | 1/1966 | Rosen . | |
| 3,447,165 | 6/1969 | Brosk . | |
| 3,477,552 | 11/1969 | Goldman . | |
| 3,774,249 | 11/1973 | Ybarra et al. . | |
| 3,789,546 | 2/1974 | Morrison . | |
| 3,820,276 | 6/1974 | Goldfarb et al. . | |
| 3,831,316 | 8/1984 | Weistrop . | |
| 3,851,419 | 12/1974 | Kaelin . | |
| 3,864,871 | 2/1975 | Kaelin . | |
| 3,955,309 | 5/1976 | Noble . | |
| 4,062,076 | 12/1977 | Albertson . | |
| 4,091,481 | 5/1978 | Redman . | |
| 4,174,059 | 11/1979 | Maunder . | |
| 4,236,263 | 12/1980 | Allee . | |
| 4,288,222 | 9/1981 | Kling . | |
| 4,304,065 | 12/1981 | Baiera . | |
| 4,316,287 | 2/1982 | Rule | 5/413 |
| 4,336,665 | 6/1982 | Moreau . | |
| 4,372,077 | 2/1983 | Balbuena . | |
| 4,413,442 | 11/1983 | McSweeney . | |
| 4,458,372 | 7/1984 | Mills | 5/413 |
| 4,505,687 | 3/1985 | Munro . | |
| 4,543,669 | 10/1985 | Katz | 446/73 |
| 4,563,159 | 1/1986 | Hills et al. . | |
| 4,590,633 | 5/1986 | Pickens | 5/413 |
| 4,614,505 | 9/1986 | Schneider et al. | 446/372 |

OTHER PUBLICATIONS

"Pillow Fight?", an advertisement for DREAM PALS, The Bibb Co., appearing on p. 11 of Home Furnishings Weekly, Jun. 29, 1987.

*Primary Examiner*—Alexander Grosz

[57] ABSTRACT

An article is convertible from the general shape and appearance of a plush, stuffed toy to that of a covering such as a blanket having an applique or overlay applied thereto. The article includes portions which can be relatively moved for reversing the features of the figure and for containing the covering within a cavity in the figure when it is configured as a plush, stuffed toy.

20 Claims, 6 Drawing Sheets

CONVERTIBLE FIGURE

FIELD OF THE INVENTION

This invention relates in general to articles used as toys or dolls and more particularly to a figure which can be reconfigured from an article having the appearance of a plush doll into an article having the appearance of a blanket and vice versa.

BACKGROUND OF THE INVENTION

Plush soft figures such as dolls and stuffed animals have delighted children and adults for many years. The figures have taken on an indescribable number of appearances and are loved by young and old alike. Very young children are particularly fond of such figures, holding and caressing them for hours at a time.

Infants and young children are very interested in touching and manipulating the objects in the world surrounding them, and have an insatiable curiosity about how things are put together. Infants closely study the activities of their parents and enjoy watching them assemble and disassemble the myriad of toys adapted for that purpose. It is well-known that observing the construction and the disassembly of objects assist infants in developing their cognitive processes, and as they grow older, the children develop motor skills and eye-hand coordination by doing for themselves what they observed their parents doing.

Children also love soft cuddly things to cover themselves with, squeeze, roll up or lie on.

Accordingly, the principal object of this invention is to provide an article which serves the purposes discussed above, and many others. The convertible figure described and claimed herein, has the capability of being configured into a soft doll or toy such as a teddy bear, and also to be configured into a substantially flat covering means such as a blanket. In contrast with other attempts to develop articles having similar capabilities, the present invention employs unique means which enable the entire article to lie essentially flat, as a blanket having an applique attached to its surface. Therefore, the present invention achieves a very neat appearance as both a figure and a covering means through the use of unique and unobvious construction techniques facilitating a quick and easy change from one configuration to the other.

SUMMARY OF THE INVENTION

In a broad aspect of the invention, a convertible figure is provided with a body formed by body members which define a cavity within the body. Covering means are attached to the body members and are adapted to fit into the cavity and also to be removed from the cavity.

In accordance with another aspect of the invention, the body includes a head and a torso.

In yet another aspect of the invention, the cavity is defined by portions of both the head and the torso.

The convertible figure has two configurations; namely, a first configuration wherein the covering means is enclosed within the cavity and a second configuration wherein the covering means is outside the cavity.

In accordance with another aspect of the invention, the head of the convertible figure includes a first face visible when the figure is configured in its first configuration, and a second face which is visible when the figure is configured in its second configuration. As the figure is changed from its first to its second configuration and vice versa, the first and second faces are reversed. The two faces are joined together and configured such that when the convertible figure is in its first configuration the cavity in the head is located in a space between the body members forming the first and second faces. A portion of the covering means is then housed within this cavity. In its second configuration, the covering means is removed from this cavity located between the two faces, the second face is reversed, and the covering means is withdrawn from the cavity.

In accordance with another aspect of the invention, at least one first upper appendage, such as a hat or a horn, is attached to the head and is visible when the figure is configured in its first configuration. At least one second upper appendage is also attached to the head and it is visible when the figure is configured in its second configuration. In practice, as the first and second faces are reversed the first upper appendage is concealed and the second is exposed or vice versa. A plurality of first and second upper appendages may be attached to the head. For example, the appendages may be ears, horns, ears in combination with a hat, etc.

In accordance with another aspect of the invention, the convertible figure further comprises at least one first middle appendage attached to the torso and visible when the figure is configured in its first configuration, and at least one second middle appendage attached to the torso and visible when the figure is configured in its second configuration. These middle appendages may be arms, tentacles, etc. As the convertible figure is reversed from one configuration to the other, the first and second middle appendages would be alternatively concealed and exposed.

In yet another aspect of the invention, reversing means are provided in the head for passing the upper appendage or appendages through the reversing means whereby the upper appendage or appendages are visible when the figure is configured in either its first or second configuration. For example, the reversing means may be a slot through which an ear may pass as the head is reversed to show either the first or second face.

In a further aspect of the invention, reversing means are included in the torso for passing the middle appendage or appendages through said reversing means whereby the same middle appendage or appendages are visible when the figure is configured in either its first or second configurations. The reversing means may be a passage through which an arm passes as the reconfiguration takes place.

In accordance with another aspect of the invention, the torso includes means for removing the covering means from the cavity when the figure is converted from its first configuration to its second configuration. The means for removing may be a closable opening which when opened exposes the cavity and the covering means located therein. The covering means is then pulled from the cavity during the conversion of the figure from its first to its second configuration. This opening is also the means through which the covering means is inserted into the cavity as the figure is converted from its second to first configuration. The means for removing is closed when the figure is in its second configuration giving the figure a neat appearance.

In another aspect, the figure may include at least one lower appendage, such as a leg or legs, dependent from the torso. The lower appendage or appendages are adapted to be visible when the figure is configured in both its first and second configurations.

In another aspect of the invention, the means for removing includes means for opening the body members which define the cavity, for gaining access to the covering means located within the cavity when the figure is in its first configuration and as means for replacing the covering means into the cavity when the figure is configured in its second configuration.

In accordance with another aspect of the invention, means are provided for reversing the first and second faces when the figure is converted from its first to its second configuration and vice versa.

In another aspect of the invention, means are provided for closing the body members after the covering means is removed from the cavity as the figure is being converted from its first to its second configuration.

In accordance with another feature of the invention, the body members forming the torso have a first and a second side, the first side being visible when the figure is configured in its first configuration and a second side being visible when the figure is configured in its second configuration. The means for closing the body members is located on one side of the figure when the figure is configured in its second configuration and the means for opening the body members is located on the opposite side of the figure when the figure is configured in its first configuration.

In accordance with another feature of the invention, the body members are adapted to lie substantially flat on the covering means when the figure is configured in its second configuration.

Other objects, features and advantages of the invention will become apparent form a consideration of the following detailed description and the accompanying drawings.

DETAILED DESCRIPTION OF THE DRAWINGS

Figure 2:
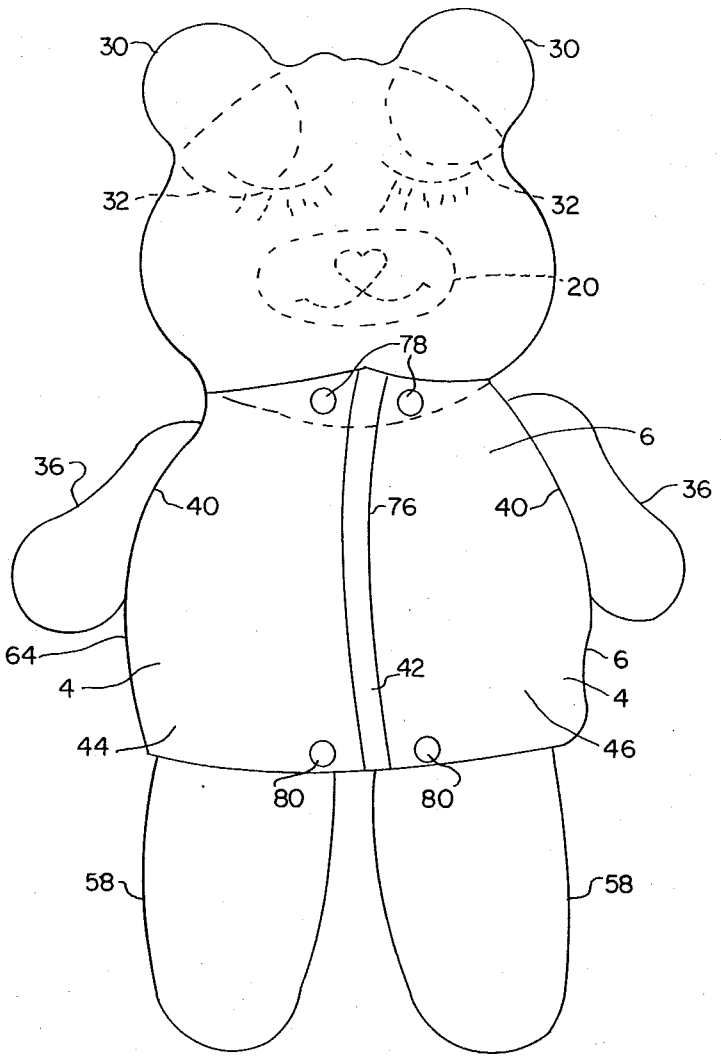
FIG. 2 is a back view of the convertible figure of FIG. 1 showing certain internal features depicted in phantom lines.

A preferred embodiment of a convertible figure including a body, body members forming the body of the figure, a cavity defined by the body members, covering means attached to the body members, the covering means adapted to fit into the cavity when the figure is configured in its first configuration as a plush bear doll, and the covering means adapted to be removed from the cavity when the convertible figure is configured in its second configuration as a covering means, is depicted in FIGS. 1 through 8.

A body 2 having the shape of a bear is depicted in the drawings as the general shape of the present invention. However, any shape of figure may be chosen including human shapes, other animals such as kittens, dogs, rabbits, etc. Insect shapes may be used as well as aquatic creatures such as fish or octopus. In other words, virtually any figure having a body may be used to practice the invention described and claimed herein.

Figure 3:
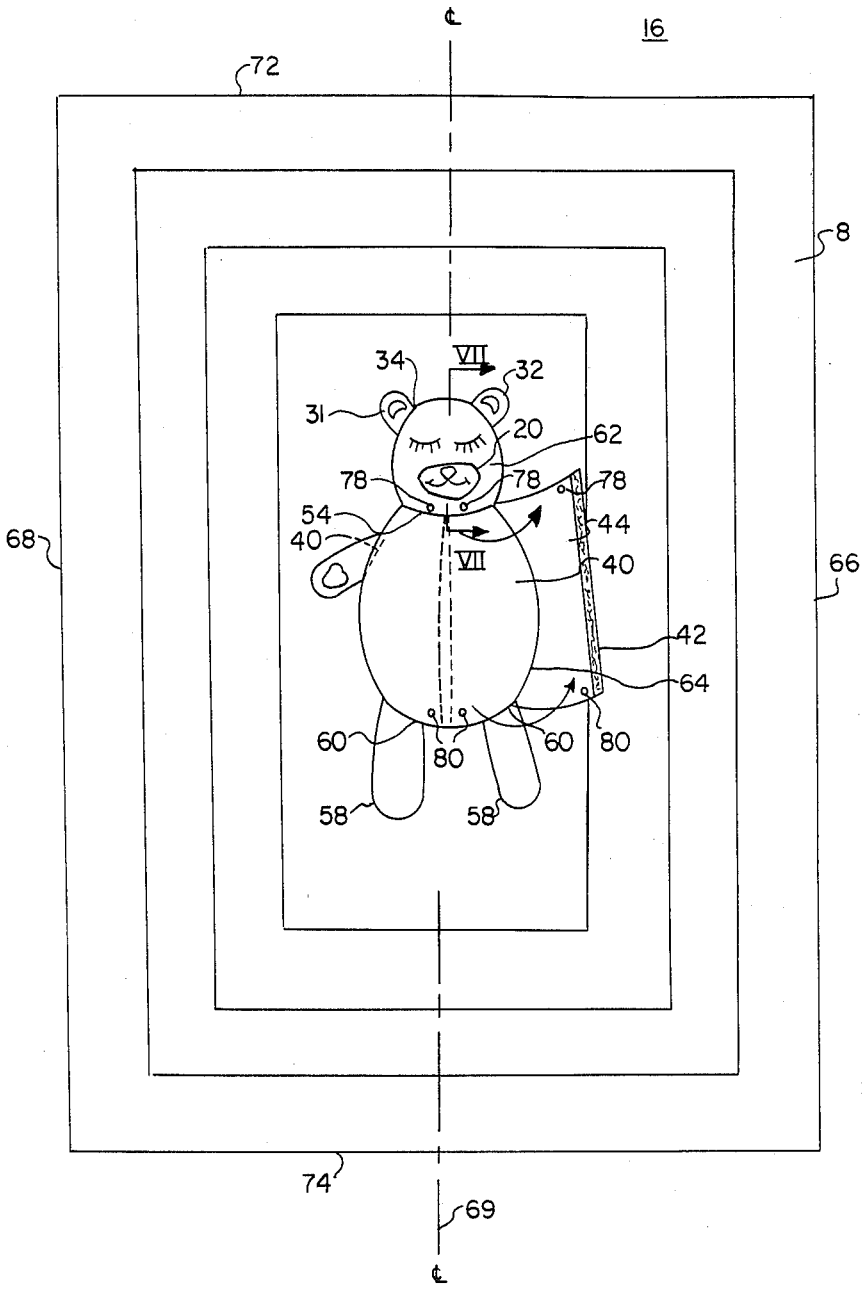
FIG. 3 is a top view of a convertible figure configured in its second configuration and appearing as an applique on a covering means.
Figure 5:
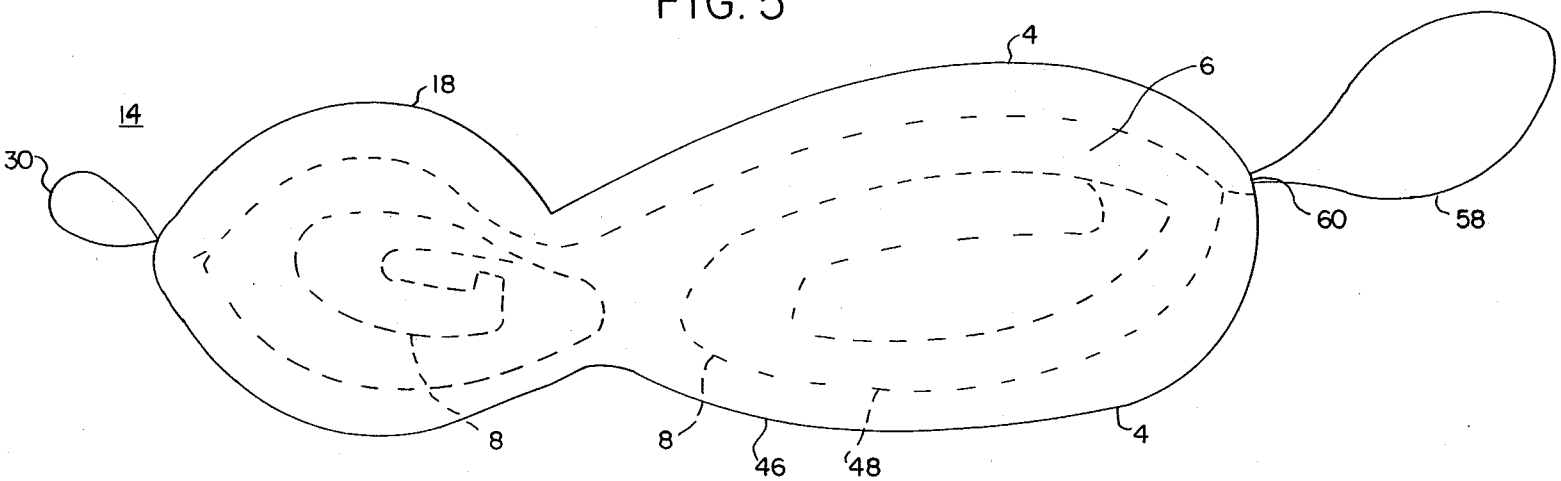
FIG. 5 is a section view of the figure in FIG. 1 along plane V—V.
Figure 4:
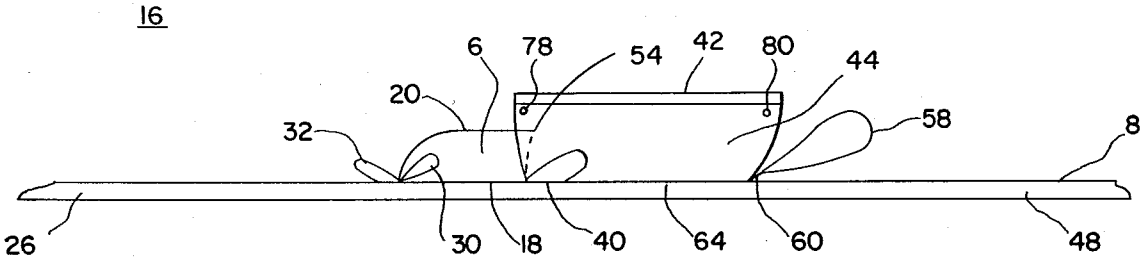
FIG. 4 is a schematic side view of a convertible figure depicted in its second configuration and having one of the body members open.

Body members 4, which in the preferred embodiment are surfaces which define the shape of the bear figure, form the body 2 of the figure. Portions of the body members 4 define a cavity 6 within the body 2. Covering means are shown in the preferred embodiment as blanket 8 which is adapted to fit into the cavity 6 as depicted in FIG. 5. When the blanket 8 is removed from the cavity 6 it can be laid flat as is depicted in FIG. 3.

The preferred embodiment has a body 2 which includes a head 10 and a torso 12. The cavity 6 is defined by portions of both the head 10 and the torso 12. Therefore, the cavity 6 is formed by the entire body 2.

Figure 1:
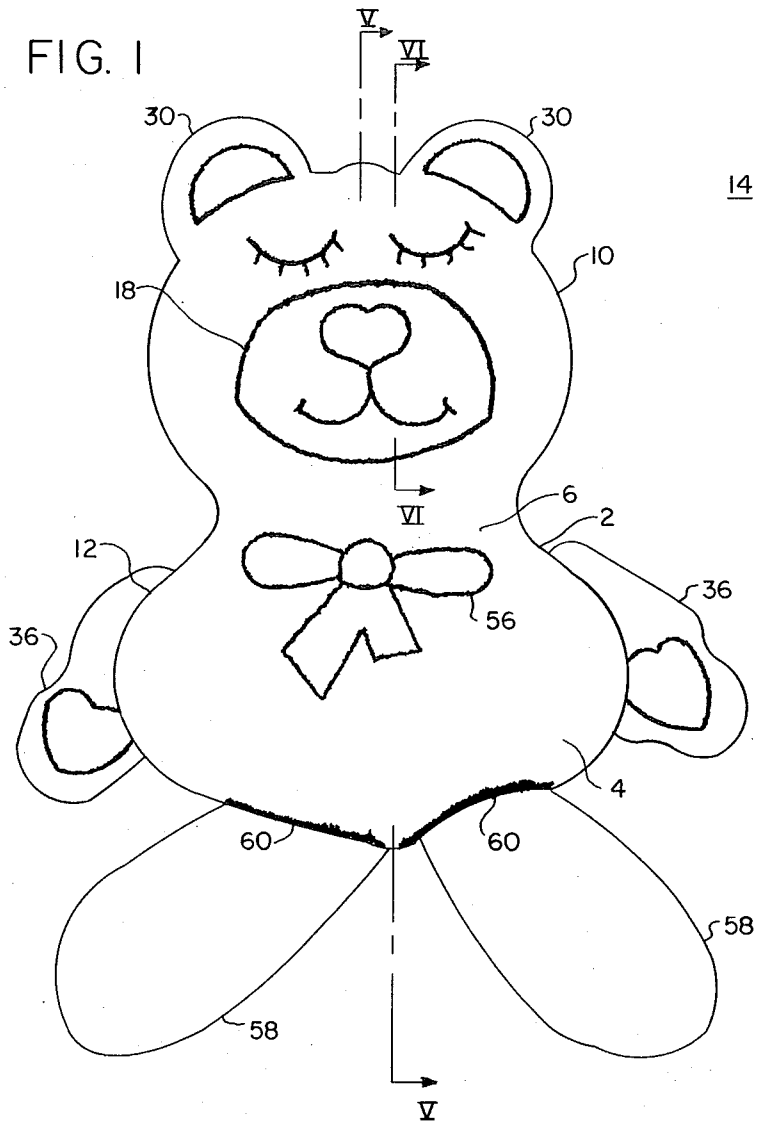
FIG. 1 is a front view of a convertible figure having the features of a bear.

FIGS. 1 and 2 depict the preferred embodiment of the convertible figure in its first configuration 14. The second configuration 16 can be seen in FIG. 3, which shows the blanket 8 outside the cavity 6. The left flap 44 is also shown partially opened, as would be the case during a conversion process, as will be described below.

Figure 6:
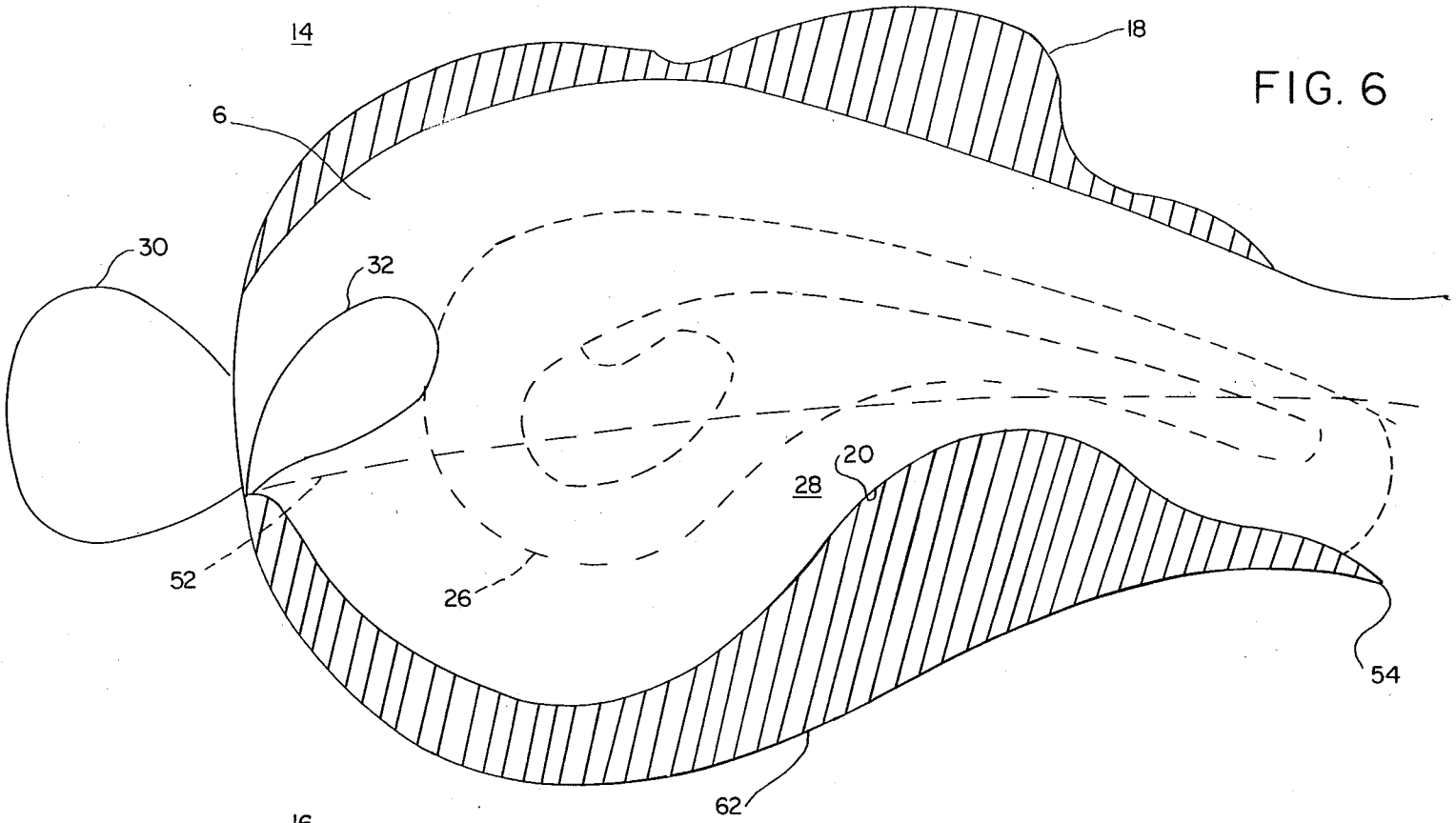
FIG. 6 is a section view of the head along a plane VI—VI in FIG. 1.

The head 10 includes a first face 18 which is shown in FIG. 1 as a muzzle having a nose, mouth and eyes in the closed position. A second face 20 is depicted in FIG. 2 in phantom lines as a muzzle with nose, mouth and eyes in the closed or open position. Second face 20 is also depicted in FIG. 3. When the convertible figure is configured in its first configuration, as is depicted in FIG. 6, first face 18 is visible and second face 20 is hidden within cavity 6. In its second configuration depicted in FIG. 7, the convertible figure has its second face 20 visible with its first face 18 hidden below it.

First face 18 is attached to blanket 8 in FIG. 6 by head stitches 52 located at the periphery of the first face 18. Second face 20 is attached to blanket 8 along its periphery, which coincides with the periphery of first face 18, except that neck 54 is unattached. When the convertible figure is being reconfigured from its second configuration 16 to its first configuration 14, blanket 8 is rolled and folded at its top part 26 to a position which in FIG. 4 would be substantially below first face 18 and second face 20. Second face 20 is then reversed over the top 26 of blanket 8 forming a pocket 28 around the blanket top 26. As can be seen from referring to FIGS. 4, 6 and 7 the second face 20 which was visible when the figure was configured in its second configuration 16 now faces the interior of pocket 28 after the reversal of the faces. The first face 18 which was concealed in the portion of the cavity 6 formed by the head 10, i.e. pocket 28, is now visible after the reversal is completed.

This processes is reversed when the figure is being converted from its second configuration 16 to the first configuration 14. The blanket top 26 is pulled from pocket 28, second face 20 is reversed over first face 18 whereby second face 20 becomes exposed and first face 18 becomes hidden.

The preferred embodiment of the convertible figure, which depicts a bear, has two upper appendages which are first ears attached to head 10. The first upper appendages are first ears 30 which are visible when the figure is configured in its first configuration. It has second upper appendages; namely, second ears 32, which are visible when the figure is configured in its second configuration, but which are concealed within pocket 28 when the figure is configured in its first configuration. As the first and second faces 18 and 20 are reversed when the convertible figure is converted from its second to first configurations and vice versa, first ears 30 or second ears 32 are alternately exposed.

Alternatively, instead of there being at least one first upper appendage and at least one second upper appendage, i.e. first ears 30 and second ears 32, only one set of upper appendages, or one upper appendage needs to be provided if an upper appendage reversing means such as slot 34 is utilized. Looking to FIGS. 3 and 4, as the figure in its second configuration 16 is being converted to its first configuration 14, second face 20 is reversed over blanket top 26 exposing first face 18. Employing slot 34, ear 31 is then passed through the slot so that it is visible at the same time that first fact 18 is visible. Converting the figure from its first to second configurations is merely the reverse of the above with second face 20 being reversed over first face 18 and ear 31 being passed through slot 34 so that ear 31 and face 20 are simultaneously visible.

The preferred embodiment also utilizes middle appendages which, in the case of a bear, are arms or forelegs. First middle appendages are depicted as first arms 36 which are attached to torso 12 and which are visible when the figure is configured in its first configuration 14. First arms 36, and all of the other appendages discussed herein, may be attached by any suitable means including stitching. Second middle appendages are shown as second arms 38. The use of first arms 36 and second arms 38 is similar to the operation of ears 30 and second ears 32. When the figure is configured in its first configuration 14, then first arms 36 are visible, and when the figure is converted to its second configuration 16, second arms 38 are visible. Because the arms are bulkier than the ears, in the preferred embodiment it is preferable to employ middle appendage reversing means in the torso for passing the middle appendages therethrough during the reversal process.

The middle appendage reversing means in the torso are shown as passages 40. As the torso portion of the body is reversed, the arms 36 are passed through the passages 40 making the arms 36 visible when the figure is configured in either its first or second configurations.

Reversing the torso 12 portion of the body 2 from its first configuration 14 to the second configuration 16 will now explained. The torso 12 includes means for removing the covering means or blanket 8 from the cavity 6 when the figure is converted from its first configuration 14 to its second configuration 16. The means for removing is depicted in the drawings as a means for opening depicted as closure 42, left flap 44 and right flap 46. In the preferred embodiment, closure 42 comprises a hook and loop fastening means such as Velcro which joins the left flap 44 and right flap 46 located on the back of the figure. When the figure is configured in its first configuration 14, the lower portion 48 of blanket 8 is rolled and folded and enclosed within the portion of cavity 6 located within torso 12. When converting the figure from its first to second configuration, the means for opening or closure 42 is opened and left flap 44 and right flap 46 are allowed to open freely. The lower portion 48 of blanket 8 is then unrolled and unfolded from the portion of the cavity 6 located within torso 12. The top portion 26 of blanket 8 is then withdrawn from the pocket 28 and second face 20 is reversed behind first face 18. The entire blanket 8 may then be laid flat. Left flap 44 and right flap 46 are then closed on the surface of blanket 8 as will be described below.

Figure 7:
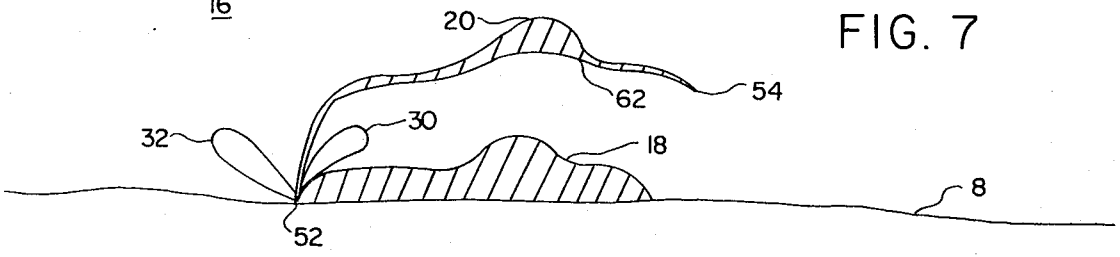
FIG. 7 is a section view of the head along a plane VII—VII in FIG. 3.
Figure 8:
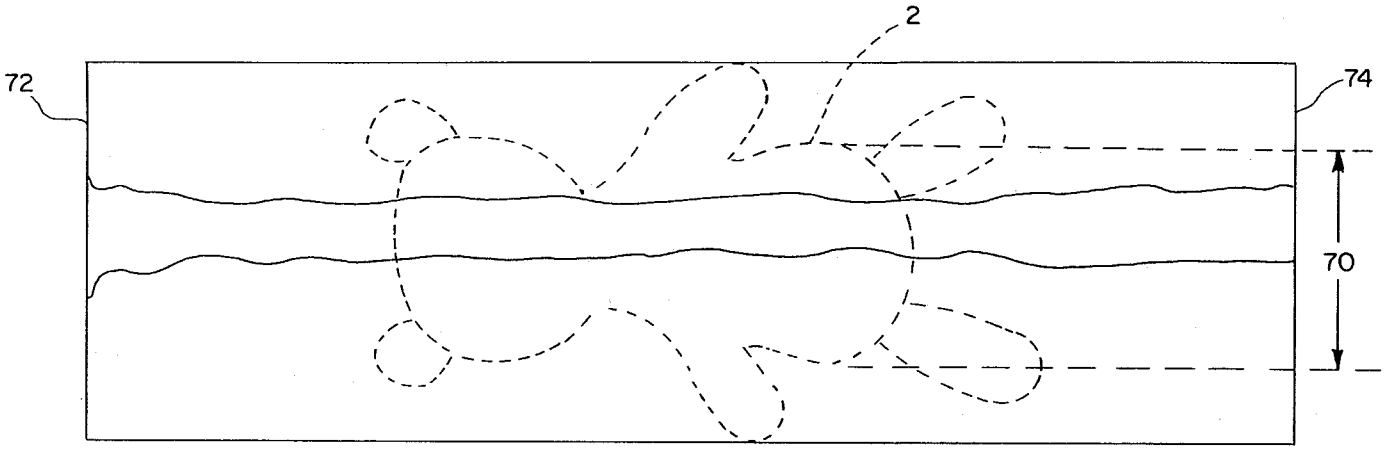
FIG. 8 is a bottom view of the convertible figure at a mid-stage of the converting process.

A face reversing means for reversing the first and second faces when the figure is converted from the first to the second configuration and vice versa, is shown in the preferred embodiment in FIGS. 6 and 7. FIG. 6 is a cross-sectional view of portions of the head configured in the first configuration 14, and FIG. 7 is a cross-sectional view of head 10 in its second configuration 16. The face reversing means includes the following. As can be seen in FIG. 6, first face 18 is visible when head 10 is configured in its first configuration. Second face 20 is enclosed within pocket 28 and is not visible. Head stitches 52 join the two faces together to form pocket 28 within which top portion 26 of blanket 8 is contained. During the reversal process, the top portion 26 of the blanket 8 is removed from pocket 28, second face 20, which is loose at neck 54 is turned over on top of first face 18 concealing first face 18 and exposing second face 20. In effect, pocket 28 is turned inside out concealing the exterior portions of the pocket 28 on which first face 18 is located and exposing the interior portions of the pocket 28 on which second face 20 is located.

It may be helpful to an understanding of the operation of the present invention to explain briefly the technique of constructing the figure depicted in the drawings. Initially, a blanket 8 is chosen which has appropriate dimensional, thickness and surface characteristics. A first face 18 of an appropriate size is then applied to the surface of blanket 8 by any suitable means such as embroidery, silk screening or heat bonding. Decorations such as a bow 56 are applied in the same manner as first face 18. First ears 30, first arm 36, and second arm 38 are attached to the surface of blanket 8 by any suitable means such as stitching. The ears and arms are, of course, sized and positioned in the proper places to make the figure, which in the preferred embodiment is a bear, appear to have the correct form which such a figure should have. Additionally, at least one lower appendage may be attached to the surface of blanket 8 which, when construction is complete, will have the appearance of being dependent from the torso 12. In the preferred embodiment, two lower appendages are attached, and are legs 58. The legs 58 are attached in such a manner so that they are visible when the figure is configured in both its first and second configurations. This attachment can be made in any suitable manner such as by stitching at junction 60. The legs 58 are joined only at junction 60 allowing them to be moved freely when the figure is configured either in its first configuration 14 or its second configuration 16.

Continuing with the construction details, the second face 20 is applied to a piece of fabric 62 in any appropriate manner such as embroidery. Fabric 62 and second face 20 have substantially the same size and configuration as first face 18, but may also have differences. For example, while second face 20 may show closed eyes, first face 18 may show open eyes. Different faces entirely may be chosen to give the figure a completely different appearance when it is configured in either its first or second configurations. The fabric 62 on which is applied second face 20 is attached to the surface of blanket 8 over first face 18, concealing first face 18. Fabric 62 may be attached by any appropriate means, including stitching. During construction, ears 30 are folded down toward the muzzle on first face 18 so as to be concealed inside pocket 28 which is formed between the blanket 8 and fabric 62 after fabric 62 is attached to blanket 8. Fabric 62 is attached around its entire periphery except for at the neck 54 which is left open. Second ears 32 are then sewn to surface 8 in the appropriate place to give the bear, or other design chosen, a pleasing appearance.

Left and right flaps, 44 and 46 respectively, are then attached to the surface of blanket 8. The configurations of the two flaps 44 and 46 are such that when they are closed at the closure 42, the two flaps have the shape of the torso 12. Snaps 78 and 80 may also be employed to attach the flaps 44 and 46 to the neck 54 and/or the torso 12. The flaps are attached to the surface of blanket 8 at their outside edges 64 by any suitable means such as stitching. When the left flap 44 and right flap 46 are opened at the closure 42, they have the appearance of an open jacket attached at outside edges 64. The surface of blanket 8 which is located under left flap 44 and right flap 46 when they are closed at the closure 42 may carry decorations such as a tie, a heart, a shirt, or any other appropriate appliques which could be made to appear when the flaps are opened at the closure 42, or made to be hidden when the flaps are closed at the closure 42.

Figure 9:
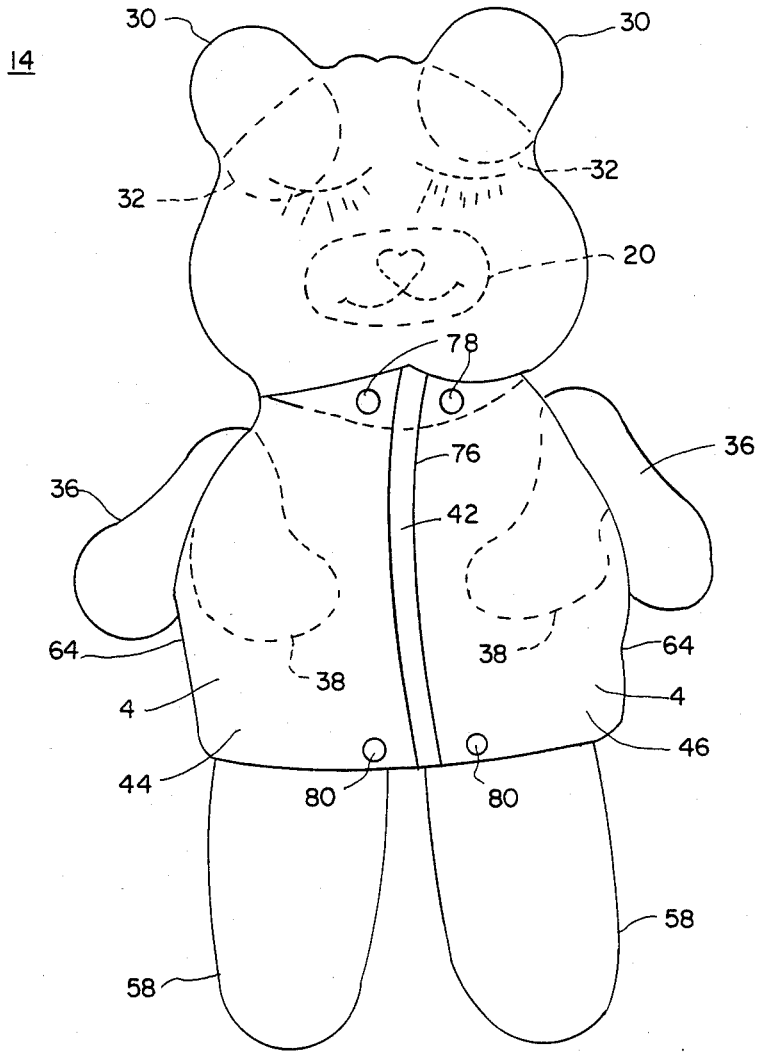
FIG. 9 is a construction detail of an alternative embodiment depicting the use of two sets of arms.

Left flap 44 and right flap 46 may each include a passage 40 so that arms 36 can be passed therethrough allowing them to be visible when the flaps 44 and 46 are either closed or opened at the closure 42. Alternatively, a second set or arms 38 may be added in a manner similar to the second ears 32. In such a construction, arms 36 would be visible when the figure were configured in its first configuration, and second arms 38 would be visible when the figure was configured in its second configuration. (See FIG. 9)

Converting the convertible figure from its second configuration to its first configuration will now be explained. In its second configuration, the bear appears as an applique or overlay on the surface of blanket 8. In converting the figure to its first configuration, the left flap 44 is detached from right flap 46 at the closure 42. If only one set of arms is employed, as is the case in the preferred embodiment, the first arms 36 are passed through the passages 40 to be visible when the left flap 44 and right flap 46 are laid open on the surface of blanket 8.

Blanket 8 is then flipped over so that the bear is lying face down. The blanket is then rolled and folded in any appropriate way, which in the preferred embodiment comprises folding the blanket by bringing the left ouside edge 66 toward the centerline 69 of blanket 8 and the right outside edge 68 also toward the centerline 69 of blanket 8. An appropriate number of folds are made so that the width 70 of the blanket 8 is approximately the same width as the body 2 of the convertible figure. The top edge 72 of blanket 8 is then rolled and/or folded over the head 10; second face 20 is pulled by neck 54 over this folded portion of blanket 8 forming the pocket 28 in which the top portion 26 of blanket is retained. By this maneuver, first face 18 becomes exposed, and second face 20 becomes concealed within pocket 28.

The bottom edge 74 of blanket 8 is then rolled and/or folded over the torso 12. The left flap 44 and right flap 46 are then brought over this lower portion 48 of blanket 8 and are joined by a means for closing 76 which, in the preferred embodiment, is the same hook and loop feature which comprised the closure 42. The left and right flaps 44 and 46 are then attached to the neck 54 portion of first face 18 by any suitable means such as snaps 78. It should be noted that upper snaps 78 are usable whether the figure is configured in its first configuration 14 or its second configuration 16. In the first configuration 14, the half of the snaps which are on the left and right flaps 44 and 46 lie on top of their mating halves on theneck 54. In the second configuration 16, the half of the snaps on the flaps 44 and 46 lie under their mating halves on the neck 54. The bottom portions of the left and right flaps 44 and 46 are attached to the torso 12 by any suitable means such as lower snaps 80. When this conversion process is completed, the convertible figure has the appearance depicted in FIGS. 1 and 2.

Means for replacing 75 the covering means into the cavity when the figure is converted from its second configuration to its first configuration was shown in the preferred embodiment as the means for closing 76, upper snaps 78, lower snaps 80, left flap 44 and right flap 46.

As can be determined from the prior description, the convertible stuffed figure of the present invention may comprise a first side on the body members forming the torso said first side being visible when the figure is configured in its first configuration, and a second side on the body members forming the torso and being visible when the figure is configured in its second configuration. The first side can be seen in the drawings in FIGS. 1 and 2 and includes first face 18, ears 30, arms 36, legs 58, left flap 44 and right flap 46. The second side includes second face 20, second ears 32, the other side of left flap 44 and right flap 46, and legs 58. The term blanket is used herein to denote a type of covering means in a generic sense, without regard to whether various people would refer to the same member by that or by some other term. Like any blanket, the blanket 8 has two sides or surfaces, which can be distinguished from one another by use of terms such as front surface, for the side which faces ouwards in use, and rear surface, for the side which faces a person covered by, e.g. sleeping under the blanket when in use.

Of the body members of the figure such as a plush, stuffed toy which is attached to the blanket, one can be distinguished from the other by use of terms such as front layer and rear layer. The blanket and the layers of the body of the figure have respective outer perimeters, each defined by respective edge portions, such as left and right, and upper and lower edges.

Another synonym for the figure such as a plush stuffed toy is a soft-sculptural creature.

The snaps, Velcro closures, stitching and bonding which have been described can be denoted generically by the term 'means for securing'.

Like the legs, the arms of the soft-sculptural creature are shown being elongated and having one end attached near the torso and having an opposite, free end.

It can also be seen that the means for closing 76 is located on one side of the figure when the figure is configured in its first configuration, and that the means for opening or closure 42 is located on the opposite side of the figure when the figure is configured in its second configuration.

As can be seen from FIG. 3, the body members 4, which include second face 20, second ears 32, arms 36, left flap 44 and right flap 46 are adapted to lie substantially flat on the covering means 8 when the figure is configured in its second configuration.

It is to be understood that the disclosed apparatus is merely illustrative of the principles of the present invention which could be implemented by other types of structures constructed of different materials such as plastic polymers, or elastomeric compounds. Accordingly, the scope of the present invention is not limited to the embodiments as shown in the drawings and specifically described herein.

What is claimed is:

1. A convertible figure comprising:

a body including first and second body members for forming a head and a torso;

portions of both said first and said second body members defining a cavity within said head and said torso;

covering means attached to at least one of said body members, said covering means being adapted to fit into and be enclosed within said cavity in a first configuration of said convertible figure and to be removed from and be disposed outside of said cavity in a second configuration of said convertible figure; said head including a first face provided on said first body members and disposed to be visible when said figure is configured in said first configuration, and a second face provided on said second body members and disposed to be visible when said figure is configured in said second configuration.

2. The convertible figure as defined in claim 1 further comprising:

at least one fist upper appendage attached to said head and disposed to be visible when said figure is configured in said first configuration; and at least one second upper appendage attached to said head and disposed to be visible when said figure is configured in said second configuration.

3. The convertible figure as defined in claim 1 further comprising:

at least one first middle appendage attached to said torso and disposed to be visible when said figure is configured in said first configuration; and at least one second middle appendage attached to said torso and disposed to be visible when said figure is configured in said second configuration.

4. The convertible figure as defined in claim 1 further comprising:

at least one upper appendage attached to said head and disposed to be visible when said figure is configured in said first configuration; and upper appendage reversing means in said head for passing said upper appendage through said reversing means whereby said upper appendage is disposed to be visible when said figure is configured in said second configuration.

5. The convertible figure as defined in claim 1 further comprising:

at least one middle appendage attached to said torso and disposed to be visible when said figure is configured in said first configuration; and middle appendage reversing means in said torso for passing said middle appendage through said reversing means whereby said middle appendage is disposed to be visible when said figure is configured in said second configuration.

6. The convertible figure as defined in claim 1 wherein the torso includes means for removing the covering means from the cavity when the figure is converted from said first configuration to said second configuration.

7. The convertible figure as defined in claim 6 wherein the means for removing includes means for opening the body members defining the cavity, for gaining access to the covering means contained within the cavity when the figure is in said first configuration.

8. The convertible figure as defined in claim 7 further comprising means for closing the body members after the covering means is removed from the cavity and the figure is configured in said second configuration.

9. The convertible figure as defined in claim 8 further comprising:

a first side on the body members forming the torso;

a second side on the body members forming the torso;

the first side on said body members being disposed to be visible when the figure is configured in said first configuration;

the second side on said body members being disposed to be visible when the figure is configured in said second configuration;

the means for closing the body members being located on one side of the figure when the figure is configured in said second configuration; and the means for opening the body members being located on the opposite side of the figure when the figure is configured in said first configuration.

10. The convertible figure as defined in claim 1 further comprising at least one lower appendage dependent from the torso.

11. The convertible figure as defined in claim 10 wherein said lower appendage is adapted to be visible when the figure is configured in both said first and second configurations.

12. The convertible figure as defined in claim 1 further comprising face reversing means for reversing the first and second faces when the figure is converted from said first to said second configuration and vice versa.

13. The convertible figure as defined in claim 1 wherein the body members are adapted to lie substantially flat on the covering means when the figure is configured in said second configuration.

14. A convertible figure, comprising:

a blanket having an outer surface and an inner surface and having edges forming an outer perimeter;

a soft sculptural creature including:

a torso portion including a first layer having an outer perimeter, said torso first layer being attached about at least a major portion of the outer perimeter thereof to said front surface of said blanket;

a head portion including a first layer adjoining said torso portion first layer and a second layer, both of said layers of said head portion having respective outer perimeters and one of said layers of said head portion being attached to the other about a major portion of its own outer perimeter, but not at a minor portion adjacent said torso portion, so as to define an opening into said head portion adjacent said torso portion between said first layer of said head portion and said second layer of said head portion;

said torso portion also including a second layer having an outer perimeter, said torso portion second layer including an upper edge, left and right edges and a lower edge;

means for securing said torso second layer at said left and right edges thereof so as to adjoin corresponding portions of said torso first layer;

means for securing said torso second layer along said upper edge thereof to said second layer of said head portion adjacent said opening into said head portion;

means for securing said torso second layer along said lower edge thereof to said torso first layer so as to adjoin a corresponding portion of said torso first layer, whereby said first layer and said second layer of said torso define between them a torso cavity;

at least two of said means for securing being disengageably engageable so as to permit said torso cavity to be opened and closed;

said blanket, while remaining attached to said first layer of said torso portion, being selectively positionable in two alternate positions, including:

a first position in which said blanket is condensed by at least one of rolling and folding and is stuffed substantially completely into said soft-sculptural creature so as to be disposed partly in said torso cavity and partly in said head portion through said opening into said head portion, and a second position in which said blanket is located outside said head and said torso cavity of said soft-sculptural creature and spread so that a person may be covered by the blanket with said head portion and at least one of said layers of said torso visible from in front of the blanket; and means defining a creature face disposed externally on said first layer of said head portion when said blanket is disposed in said first portion.

15. The convertible figure of claim 14, wherein:

said soft-sculptural creature further includes at least one elongated appendage having opposite ends including a free end, and an end secured to said blanket so as to adjoin a respective said edge of said torso rear layer.

16. The convertible figure of claim 15, wherein:

said at least one elongated appendage comprises a left arm and a right arm which respectively adjoin said left and right edges of said rear layer of said torso portion.

17. The convertible figure of claim 15, wherein:

said at least one elongated appendage comprises a left leg and a right leg which respectively adjoin said lower edge of said rear layer of said torso portion.

18. The convertible figure of claim 17, wherein:

said left leg and said right leg are disposed to remain outside said torso cavity and outside said head portion as said blanket is moved between said first position and said second position.

19. The convertible figure of claim 15, wherein:

said appendage is provided with a representation of an anatomical feature which faces forwardly of said soft-sculptural creature both when said blanket is in said first position and when said blanket is in said second position.

20. The convertible figure of claim 19, wherein:

said appendage is an arm and said representation of an anatomical feature is of a hand or paw.

* * * * *